United States Patent [19]

Fitsch

[11] Patent Number: 4,612,678

[45] Date of Patent: Sep. 23, 1986

[54] TRAUMA BOARD AND METHOD OF USING SAME

[76] Inventor: Margot Fitsch, 870 Satucket Rd., Brewster, Mass. 02631

[21] Appl. No.: 710,300

[22] Filed: Mar. 11, 1985

[51] Int. Cl.[4] ..... A61G 1/00; A61G 1/04

[52] U.S. Cl. ..... 5/82 R; 5/436; 128/134

[58] Field of Search ..... 5/82 R, 82 B, 89, 434, 5/436; 128/134

[56] References Cited

U.S. PATENT DOCUMENTS

| | | | |
|---|---|---|---|
| Re. 24,377 | 10/1957 | Creelman | 5/436 |
| 2,141,100 | 12/1938 | Warden | 5/82 |
| 2,361,789 | 10/1944 | Nicholas | 5/82 |
| 3,347,544 | 10/1967 | Uffenorde | 5/434 |
| 3,414,914 | 10/1968 | Gramins | 5/82 |
| 3,482,571 | 12/1969 | Behrendt | 5/436 |
| 3,609,778 | 10/1971 | Zeiner | 5/82 R |
| 3,650,523 | 3/1972 | Darby | 128/134 |
| 3,707,734 | 1/1973 | Matthews | 5/82 |
| 3,737,923 | 6/1973 | Prolo | 5/82 |
| 3,889,668 | 6/1975 | Ochs | 5/82 |
| 4,034,748 | 7/1977 | Winner | 5/82 R |
| 4,058,112 | 11/1977 | Johnson | 5/436 |
| 4,124,908 | 11/1978 | Burns | 5/82 R |
| 4,127,120 | 11/1978 | Applegate | 128/134 |
| 4,151,842 | 5/1979 | Miller | 5/82 R |
| 4,218,792 | 8/1980 | Kogan | 5/436 |
| 4,473,912 | 10/1984 | Scheidel | 5/82 R |
| 4,506,664 | 3/1985 | Brault | 5/82 R |

FOREIGN PATENT DOCUMENTS

| | | | |
|---|---|---|---|
| 888455 | 12/1971 | Canada | 5/82 R |
| 2003745 | 8/1971 | Fed. Rep. of Germany | 5/436 |
| 2253330 | 5/1974 | Fed. Rep. of Germany | 5/436 |
| 2409326 | 9/1975 | Fed. Rep. of Germany | 5/436 |
| 268 | of 1892 | United Kingdom | 5/82 R |
| 436549 | 10/1935 | United Kingdom | 5/82 |
| 1031814 | 6/1966 | United Kingdom | 5/82 R |

*Primary Examiner*—Edgar S. Burr
*Assistant Examiner*—Tonya Eckstine
*Attorney, Agent, or Firm*—Richard P. Crowley

[57] ABSTRACT

A trauma board, particularly a pediatric trauma board for use in lifting, carrying, transporting, treating or otherwise immobilizing a patient, which trauma board comprises: a rigid board having a head end and a foot end with the board characterized by a plurality of at least three separate, spaced apart slots therein; the first slots spaced apart in two parallel pairs, each about the width of the thickness of a patient's limb toward the foot end of the board; the second slots spaced apart generally the width of the patient's body and extending intermediate the foot and head end of the board; and the third slots spaced apart toward the head end of the board; the board also includes a foam head block characterized by a contoured head cavity therein to be secured at the head end of the board to form a foam layer about the sides, top and back of the head of the patient; and adjustable straps passing through each pair of the slots to restrain the limbs and the body of the patient, and over the top of the foam head block and forehead of the patient to restrain the outward movement of the head from the head block.

13 Claims, 6 Drawing Figures

TRAUMA BOARD AND METHOD OF USING SAME

BACKGROUND OF THE INVENTION

It is often necessary to immobilize a patient in order to lift, carry, transport or treat the patient, and for such purposes various immobilizing and restraining board devices are employed. Such devices are often referred to as restraining boards, spine boards, immobilizers, torso boards, spinal restraining boards, fracture boards, or as used herein, trauma boards. Typically, such boards are in various sizes and shapes and often contain various holes and slots therein so that straps may be passed therethrough to immobilize various parts of the patient's body, or to place the patient in various immobilized positions.

For example, typical trauma boards are described in U.S. Pat. No. 4,127,120 wherein a trauma board has peripheral slots and crossover-type straps to restrain the upper portion of a patient's body, while U.S. Pat. No. 4,369,982 is directed to a spine board which includes a foot support to prevent the patient from sliding off the spine board when raised to a vertical position, and which provides for a wheel assembly so the spine board may be easily transported. A simplified fracture board is described in U.S. Pat. No. 4,226,231 wherein a fracture board is described for emergency personnel for immobilizing the upper portion of an injured patient with a plurality of slots spaced around the periphery of the board. An infant restraining board is described in U.S. Pat. No. 3,650,523 wherein a patient is immobilized in a spread eagle-type postion, which spine board includes moveable head restraining pads on either side of the head. A spine board that includes a plurality of various slots and holes is described in U.S. Pat. No. 3,707,734 and which also includes strap means to restrain the head movement. Another slotted board used to immobilize children using a pressure release fastening means is described in U.S. Pat. No. 3,358,141, which also includes a head restraint for a child, but which head restraint comprises a head band. Spinal devices with head restraints are shown for example in U.S. Pat. No. 4,034,748 wherein a padded head restraint is used on a spinal board. An immobilizer for infants which employs a head strap and a seat with a backboard with various slots is described in U.S. Pat. No. 3,892,399.

Despite the numerously described trauma boards in the prior art, it is desirable to provide an effective, simple trauma board particularly for use with children which permits easy and rapid adjustments of the straps and for rapid and easy immobilization of each of the limbs of the patient, the body of the patient, and importantly in combination also provides for the total immobilization of the head in a simple and effective manner.

SUMMARY OF THE INVENTION

The invention relates to a trauma board and method of using the trauma board, and in particular, it concerns a pediatric trauma board particularly for use in the lifting, carrying, transporting and treatment of a child, which trauma board provides for rapid, effective and easy adjustment of the straps to immobilize the child's body and also the child's head in a comfortable and effective manner.

The trauma board of the invention comprises a rigid, flat, generally rectangular board made, for example, of wood or rigid plastic, having a head and foot end and of sufficient length to accommodate the body of a patient, typically the body of a child. The trauma board is characterized by a plurality of elongated, spaced apart, generally parallel slots therein. The elongated slots permit the rapid and easy adjustment of restraining straps used to restrain and immobilize the body limbs or body portions. The elongated slots comprise in combination first, second and third slots, which slots extend generally through the board and extend a defined length of the foot, intermediate body and head sections of the board. The first slots are spaced apart in two pairs, each pair of slots is generally spaced apart the width of about or slightly greater than the thickness of the patient's limbs, and typically of a child's limb, and run generally the length of the limb. The second pair of slots extends generally the length of the intermediate portion of the patient's body, extends intermediated to one and other ends of the trauma board, generally toward the outer periphery thereof and about or slightly greater than the width of the patient's body. The third pair of slots extends generally a shorter distance and toward the head end of the trauma board and toward the periphery thereof.

The trauma board also includes a head restraining device which comprises a semirigid or semiflexible foam head block, formed of a synthetic plastic foam or natural rubber foam material and characterized by a generally centrally positioned, contoured whole head cavity therein to form a continuous foam layer about the sides, top and back of the head of the patient to be placed on the trauma board so that the head of the patient once placed on the board the head cavity may be totally supported, yet immobilized and encompassed by the foam with only the top or face portion exposed. The depth of the foam material, which may for example be of a flexible urethane foam material (i.e 2 to 12 pounds per cubic foot), should be sufficient to take the depth of the head of the patient to provide for the forehead to be about on the level with the top surface of the foam block or slightly under or slightly above. Restraining straps are then employed through the respective elongated first, second and third slots in order to provide for immobilization of one or both of the limbs, the intermediate body portion and arms, and also to pass over and restrain the forehead from forward or outward movement of the head from the body cavity of the foam block. Typically the strap restraining means should be an easily releasable and adjustable type, and thus it is desirable to have a Velcro-type fastener on the straps (or interlocking fabric) which provides sufficient security for the rapid immobilization of the patient, but yet is easily releasable and adjustable as desired.

Optionally the foam head block may be directly secured to the head portion of the trauma board by adhesives, Velcro fasteners, etc. or preferably be merely placed thereon and retained in place by one or more restraining straps so that the foam head block may be removed if desired for moving the patient, or removed for cleaning or replacement. Optionally, but preferably, the board would contain on the bottom side a pair of spaced apart runners toward the outer periphery and extending the length of the board in order to provide board stability and ease for the user grasping the end of the board. The board may contain one or more hand holes at each end so that the board may be easily transported and carried to the scene of use. Further and importantly, the board may also include a soft, flexible foam sheet material (i.e. of urethane foam) generally with a slit through a portion of the middle of the sheet material to be placed from the foam block so as to provide a cushion for the patient, and yet, by virtue of the slit, permits the limbs of the patient to be restrained in the pair of first slots by restraining straps at the foot end of the board.

The trauma board of the invention provides a simple and effective means to immobilize a patient, particularly a small child, since the elongated slots permit easy adjustment, while the foam head piece provides for rapid and effective immobilization of the patient's head. The use of restraining straps with Velcro, easily made and releasable restraint, permits the patient to be rapidly immobilized. The board is simple in construction so that it may be manufactured at low cost and adapted for adult or children use. The combination of effective and yet cushioned head restraint which is easily applied and easily removed, together with the effective immobilization of the body, arms and limb portion of the patient provides for a unique trauma board, particularly suitable for a pediatric trauma board for emergency personnel.

The invention will be described for the purposes of illustration only in connection with a particular specific embodiment; however, it recognized that various additions, improvements and modifications of the embodiment may be made by those persons skilled in the art, all falling within the spirit and scope of the invention.

DESCRIPTION OF THE EMBODIMENTS

Figure 1:
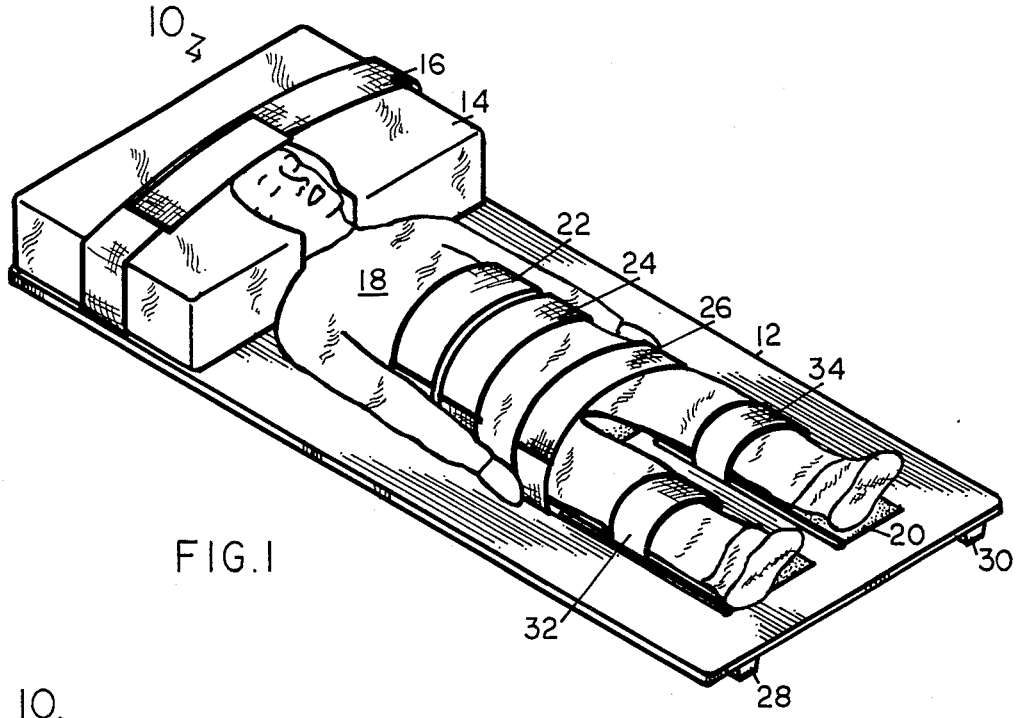
FIG. 1 is a perspective, schematic view of the trauma board of the invention showing a pediatric patient immobilized thereon.
Figure 2:
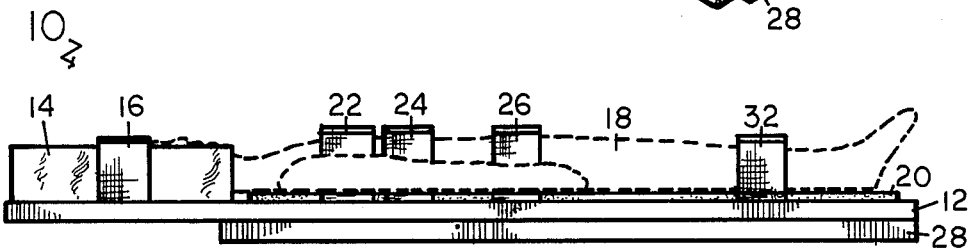
FIG. 2 is a side view of the board of FIG. 1.

FIGS. 1 and 2 show a trauma board 10 of the invention, particularly a pediatric trauma board composed of a flat wood, such as a birch plywood board 12, for example 36 inches by 15 inches and ½ inch in thickness, which has a head and foot section and a block of polyurethane foam 14 at the head section of the board 12 with a patient 18 secured to and immobilized to the board. The head of the patient fits into an oval head cavity 36 (see FIGS. 3 and 4) to cradle the child's head and to support the neck during transportation and with an adjustable strap 16 with a Velcro fastener passing over the foam block 14 and over the forehead of the child 18 to immobilize the head of the child 18 in the body cavity 36 of the foam block 14.

Optionally there is provided a thin foam body pad 20 to provide cushioning of the patient's body 18 with the board 12, with for example the foam body pad 20 having about a ¾ inch thickness and measuring about 26 inches by 9 inches, and further characterized by a slit up the middle extending in this embodiment about 12 inches from the foot toward the head to provide support for each limb of the patient 18. The patient 18 is immobilized in the body portion through adjustable straps 22, 24 and 26 and each leg is immobilized through adjustable straps 32 and 34. The straps as illustrated are secured and employ Velcro fastening which permits for adjusting for different diameters of torso and limbs of the individual patient 18. If required, additional adjustable straps may be employed to secure the ankles of the patient 18, the shoulders and the like.

As illustrated the foam block 14 may comprise a semirigid or semiflexible foam material sufficient in resiliency and the cushioning effect to support the head of the patient 18, who may for example have a dimension of 10 inches in length, 15 inches in width and a height of about 5 to 6 inches, with a neck opening of about 3 inches and with about a 1 to 2 inch padding beneath the head of the patient 18, and with the oval cavity centrally positioned in the foam block 14, roughly from 5 to 6 inches from each edge, with the oval cavity contoured to the general profile and shape of a child's head. The foam block could be sufficiently flexible and resilient enough so that the foam can be pulled away if desired from the side of the patient's head 18 to observe for blood or fluid from the ears. In addition if desired, the foam may be covered with a removable cloth or other washable cover may be employed and fit over the foam block for sanitary and cleaning purposes.

Figure 3:
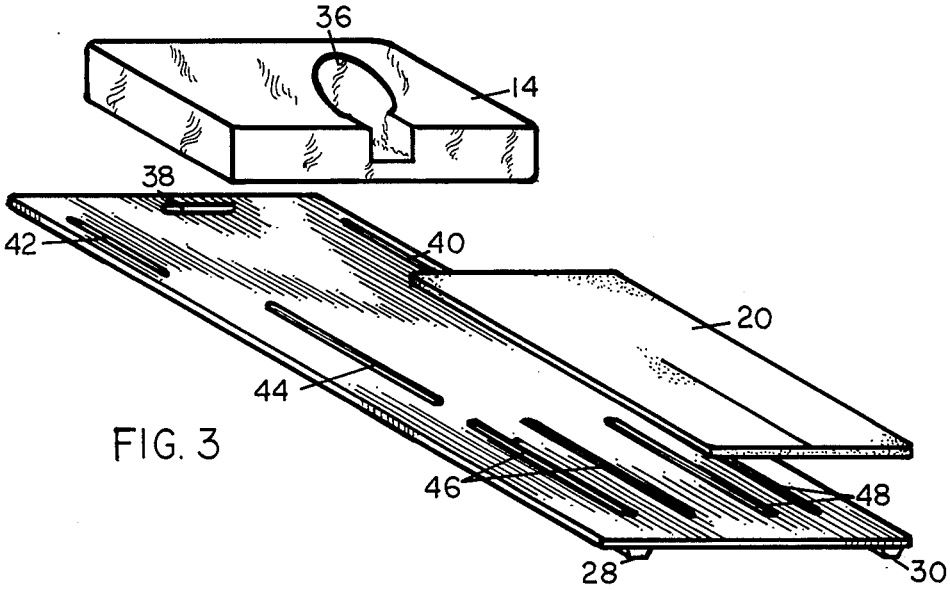
FIG. 3 is a schematic, perspective, partially exploded view of the trauma board which includes a foam sheet.
Figure 4:
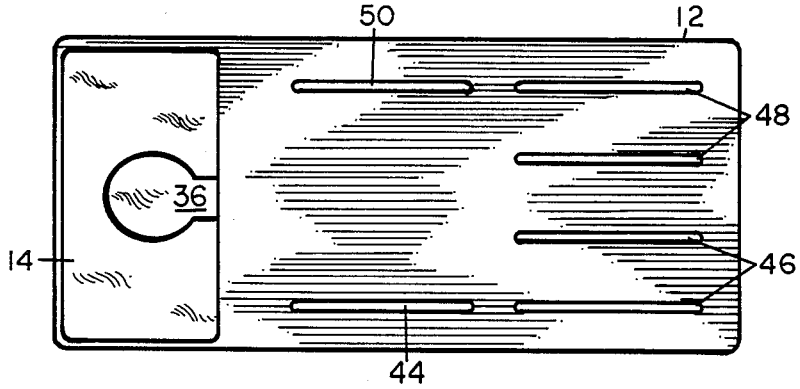
FIG. 4 is a part plan view of the trauma board.
Figure 5:
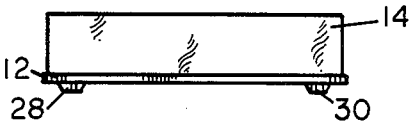
FIG. 5 is an end plan view of the trauma board.

FIG. 3 shows in particular an exploded view which shows the foam block 14, which foam block is not permanently secured to the head of the board 12, but may be if desired, although preferably the block is merely retained in position through the self-adjusting straps 16 so that the block may be removed with the patient desired and for cleaning and maintenance and for easy replacement. The foam pad 20 is shown in a flat position without the leg sections split apart to support the limbs as in FIG. 1. The board 12 is characterized by a plurality of elongated generally parallel slots which include slots 40 and 42 toward the head of the board and toward the periphery of the board 12 so that the adjustable strap 16 may be passed through the slots 40 and 42 to secure the forehead of the patient 18 in the foam cavity 36. The slots are generally approximately 6 inches long. The intermediated portion of the board 12 includes slots 44 and 50 (for instance see FIG. 4) generally parallel and spaced apart and toward the outer periphery of the board 12 and generally positioned to be slightly greater than the width of the patient, which slots are approximately 10 inches long, and through which slots the body self-adjustable straps 22 and 24 may be passed. The third generally parallel slots are slots 46 and 48 at the foot of the board 12, which slots are parallel and generally about 12 inches long and are spaced apart in an amount generally the same or slightly greater than the limbs of the patient 18. Adjustable strap 26 is passed through the outer strap peripheral slot 48 and the outer peripheral slot 46, while straps 34 and 32 are passed through the respective slots 46 and 48 to retain and immobilize the limbs of the patient 18. An additional slot as a hand grip 38 is provided at the head of the board 12 (or at the foot or both ends) in order to permit the trauma board to be carried by emergency personnel to the scene of its use.

Figure 6:
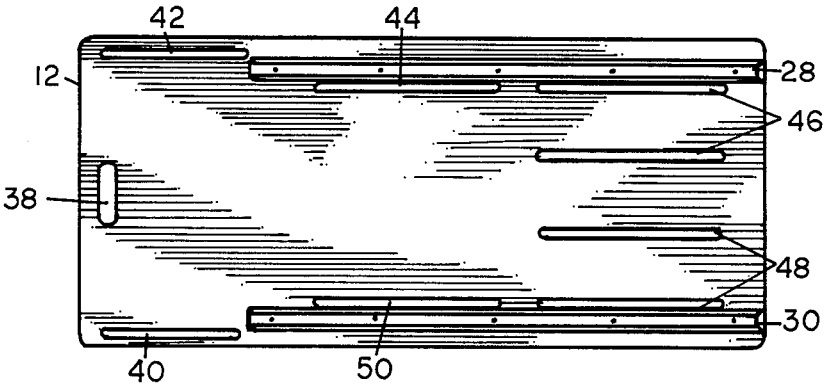
FIG. 6 is bottom plan view of the trauma board.

The pediatric trauma board 10 also includes on the bottom surface (see FIG. 6) a pair of spaced apart, generally parallel wood runners secured to the bottom surface toward the outer periphery to raise the board ½ to 2 inches off the ground in order to facilitate a user getting their fingers underneath the board to lift it after the patient has been immobilized on the board as illustrated in FIG. 1.

The pediatric trauma board as described provides for a unique combination of structural features which together permit the rapid and effective immobilization of the patient and essentially all parts of the body, while the foam head piece with the contoured cavity provides for effective immobilization of the head when employed with restraining strap. Optionally the foam sheet 20 provides a degree of cushioning for the patient. The board as illustrated may be easily carried to the scene, can be easily raised, and the immobilized patient turned safely.

The patient 18 is illustrated in FIGS. 1 and 2 with the arms free and outside of the straps 22 and 24; however, it is recognized and permitted by the pediatric trauma board 10 that the patient's arms may be enclosed within the adjustable straps 22 and 24 or in any combination of straps in restraint may be employed depending on the patient and the particular injury.

What is claimed is:

1. A trauma board for use in handling a patient to be immobilized, which trauma board comprises:

(a) a rigid, generally flat board having a head end and a surface, on which surface the patient is to be immobilized;

(b) a semirigid, one-piece, continuous foam head block means toward the head end of the board, said foam head block means having a contoured whole head and neck cavity therein, to form a foam wall about the back, sides and top of the head and the sides and back of the neck of the patient, to maintain the head of the patient immobilized, with the forehead of the patient at about the level of the top surface of said block, said foam head block being sufficiently resilient, to permit the foam material adjacent the ears of the patient to be pulled away for observation of the ears of the patient;

(c) a strap-restraining means for restraining the head of said patient in said foam block consisting of a strap passing around at least a portion of said foam block and over the forehead of said patient; and (d) patient-restraining means to immobilize the body of the patient on the surface of the board.

2. The trauma board of claim 1 which includes a pair of generally parallel, spaced apart, raised runners secured to the bottom surface of the trauma board to permit the fingers of a user to be inserted underneath the trauma board for carrying the board with the immobilized patient.

3. The trauma board of claim 1 which includes an opening toward and at the head or foot end of the trauma board to permit the trauma board to be carried to the scene of use.

4. The trauma board of claim 1 which includes a generally flat, flexible foam material on the top surface of the trauma board to provide a cushion for the patient to be immobilized, the flat foam sheet material characterized by a slit extending from the foot end toward the head end to permit the separate immobilization of the legs of the patient.

5. The trauma board of claim 1 adapted for use with children, which board is composed of wood and having a length of not greater than about 3 feet, and having a width of not greater than about 18 inches.

6. The trauma board of claim 1 wherein the foam head block means comprises a foam material having a density of about 2 to 12 pounds per cubic foot.

7. The trauma board of claim 1 wherein the foam head block means comprises a block of flexible urethane foam material.

8. The trauma board of claim 1 wherein the patient restraining means comprises a group of slots in the board and a corresponding group of restraining straps passing through the respective group of slots to immobilize the body of the patient.

9. The trauma board of claim 1 which includes a pair of slots on either side of the foam head block means said restraining strap passing through the slots and over the foam head block means and the forehead of the patient to restrain the outer movement of the patient's head from the foam head cavity.

10. The trauma board of claim 1 wherein the patient restraining means includes a plurality of restraining straps to restrain the patient's body or portions thereof, and which restraining straps comprise adjustable straps with a releasable, interlocking, fabric-type fastener means to maintain the straps in a fixed position after adjustment.

11. A trauma board for use in lifing, carrying, transporting and otherwise handling a patient to be immobilized, which trauma board comprises:

(a) a rigid, flat board having a head end and a foot end, the board of sufficient length to accomodate substantially the full body of the patient to be immobilized;

(b) the board having a plurality of elongated, spaced apart, generally parallel first, second and third pairs of slots therein;

(c) the first pairs of slots positioned toward the foot end of the board and spaced apart in two pairs, each pair of slots having a width of about or slightly greater than the thickness of the patient's legs;

(d) the second slots spaced apart and extending intermediate the head and foot end of the board and toward the outer periphery of the board and spaced apart generally about or slightly greater than the width of the patient's body;

(e) the third pair of slots toward the head end of the board and toward the outer perimeter of the board;

(f) a first strap-restraining means passing through the pair of the first slots to restrain each leg of a patient to be immobilized;

(g) a second strap-restraining means passing through the pair of second slots, to restrain the torso or arms of the patient to be immobilized by one or more straps;

(h) a semirigid, one-piece, continuous, foam head block means toward the head end of the board, said foam head block means having a contoured whole head and neck cavity therein, to form a foam wall about the back, sides and top of the head and sides and back of the neck of the patient to maintain the head of the patient immobilized, with the forehead of the patient at about the level of the top surface of said block, the foam sufficiently resilient in nature to permit the foam to be pulled away from the side of the patient's head for observation; and (i) a third strap-restraining means passing through the pair of third slots and over the top of the foam head block cavity, to immobilize the forehead of the patient and to restrain the outward movement of the patient's head from the foam block cavity.

12. The trauma board of claim 11 wherein the foam head block comprises a flexible urethane foam material.

13. A pediatric trauma board for use in lifting, carrying, transporting and otherwise handling a patient to be immobilized, which trauma board comprises:

(a) a rigid, flat board having a head end and a foot end, the board of sufficient length to accomodate substantially the full body of the patient to be immobilized;

(b) the board having a plurality of elongated, spaced apart, generally parallel first, second and third pairs of slots therein;

(c) the first pair of slots positioned toward the foot end of the board and spaced apart in two pairs, each pair of slots having a width of about or slightly greater than the thickness of the patient's legs;

(d) the second pair of slots spaced apart and extending intermediate the head and foot end of the board and toward the outer periphery of the board and spaced apart generally about or slightly greater than the width of the patient's body;

(e) the third pair of slots toward the head end of the board and toward the outer perimeter of the board;

(f) a first strap-restraining means passing through each pair of the first pair of slots to restrain each limb of a patient to be immobilized;

(g) a second strap-restraining means passing through the second pair of slots to restrain the torso or arms of the patient to be immobilized;

(h) a semirigid, one-piece, continuous foam head block means toward the head end of the board, said foam head block means having a contoured whole head and neck cavity therein to form a foam wall about the back, sides and top of the head and sides and back of the neck of the patient, to maintain the head of the patient immobilized, with the forehead of the patient at about the level of the top surface of said block, said foam head block being sufficiently resilient to permit the foam material adjacent the ears of the patient to be pulled away for observation of the ears of the patient;

(i) a third strap-restraining means passing through the third pair of slots and over the top of the foam head block cavity, to immobilize the forehead of the patient and to restrain the outward movement of the patient's head from the block cavity;

(j) a pair of generally parallel, spaced apart, raised runners secured to the bottom surface of the trauma board to permit the fingers of a user to be inserted underneath the trauma board for ease in raising the board; and (k) a generally flat, flexible foam material on the top surface of the trauma board, to provide a cushion for the patient to be immobilized, the flat foam sheet material characterized by a slit extending from the foot end toward the head end, to permit the separate immobilization of the legs of the patient.

* * * * *